US010150595B2

(12) United States Patent
Abate

(10) Patent No.: US 10,150,595 B2
(45) Date of Patent: Dec. 11, 2018

(54) LID-CONTAINER ASSEMBLY MADE OF PLASTIC MATERIAL

(71) Applicant: ABATE BASILIO & C. S.N.C., Calcinato (IT)

(72) Inventor: Davide Abate, Calcinato (IT)

(73) Assignee: Abate Basilio & C. S.N.C. (IT)

( * ) Notice: Subject to any disclaimer, the term of this patent is extended or adjusted under 35 U.S.C. 154(b) by 14 days.

(21) Appl. No.: 15/321,403

(22) PCT Filed: Jun. 19, 2015

(86) PCT No.: PCT/EP2015/063881
§ 371 (c)(1),
(2) Date: Dec. 22, 2016

(87) PCT Pub. No.: WO2015/197501
PCT Pub. Date: Dec. 30, 2015

(65) Prior Publication Data

US 2017/0152078 A1 Jun. 1, 2017

(30) Foreign Application Priority Data

Jun. 23, 2014 (IT) ..... MI2014A1140

(51) Int. Cl.
*B65D 43/02* (2006.01)

(52) U.S. Cl.
CPC ..... *B65D 43/0249* (2013.01); *B65D 43/0258* (2013.01); *B65D 2543/0049* (2013.01);
(Continued)

(58) Field of Classification Search
CPC ..... B65D 2543/00092; B65D 2543/00296; B65D 2543/00509; B65D 2543/00537;
(Continued)

(56) References Cited

U.S. PATENT DOCUMENTS 4,682,706 A * 7/1987 DeVore ..... B65D 43/0258 215/256
4,984,701 A * 1/1991 Margaria ..... B65D 41/3442 215/256

(Continued)

FOREIGN PATENT DOCUMENTS

FR 2514731 A1 4/1983
WO 9640569 A1 12/1996
WO 9958412 A1 11/1999

*Primary Examiner* — Andrew Perreault
(74) *Attorney, Agent, or Firm* — Laubscher & Laubscher, P.C.

(57) ABSTRACT

A lid-container assembly made of synthetic plastic material suitable for the transportation and storage of hazardous materials in conformity to the UN standard. The container includes a bottom and a substantially cylindrical or cone trunk side wall having an upper edge that bounds an access opening. The container is provided with a first external annular strip provided with a first circular rib and with at least one second circular rib for snap fitting of the lid. The lid includes a central part and a peripheral wall that conforms to the side wall of the container and further includes a second external annular strip that releasably engages the corresponding external annular strip of the container. The second external annular strip has an upper annular element that connects to the peripheral wall by an upturned U-shaped upper annular channel, and includes a lower annular element inserted into a lower annular channel in the form of an upwards pointing U, and an intermediate annular element for tear opening. The lower annular element of the second external strip includes a circular rib that engages a corresponding internal rib of the lower annular channel of the first external strip. The lid-container assembly further includes a first interference sealing zone between opposite surfaces of the side wall of the container and of the peripheral wall of the lid, a second contact sealing zone between the upper (Continued)

edge of the side wall of the container and the interior of the upper annular channel, and at least one third contact sealing zone between opposite engaging ribs of the first and second external annular strips.

4 Claims, 3 Drawing Sheets

(52) U.S. Cl.
CPC ..... *B65D 2543/0074* (2013.01); *B65D 2543/00092* (2013.01); *B65D 2543/0099* (2013.01); *B65D 2543/00296* (2013.01); *B65D 2543/00509* (2013.01); *B65D 2543/00537* (2013.01); *B65D 2543/00555* (2013.01); *B65D 2543/00629* (2013.01); *B65D 2543/00685* (2013.01); *B65D 2543/00796* (2013.01); *B65D 2543/00842* (2013.01)

(58) Field of Classification Search
CPC ..... B65D 2543/00555; B65D 2543/00685; B65D 2543/00796; B65D 2543/00842; B65D 2543/0099; B65D 17/401; B65D 17/4011; B65D 17/4012; B65D 17/4014; B65D 17/402; B65D 17/404; B65D 17/42; B65D 43/0249
USPC ..... 220/212.5, 276; 215/256
See application file for complete search history.

(56) References Cited

U.S. PATENT DOCUMENTS

| | | | | | |
|---|---|---|---|---|---|
| 5,373,955 | A * | 12/1994 | Marino | B65D 41/465 | 215/253 |
| 5,472,106 | A * | 12/1995 | Nofer | B65D 41/3428 | 215/256 |
| 5,730,309 | A * | 3/1998 | Jiradejnunt | A47J 47/18 | 206/503 |
| 6,279,774 | B1 * | 8/2001 | Clute | B65D 43/0256 | 220/276 |
| 7,963,419 | B2 * | 6/2011 | Burney | B65D 43/0212 | 215/344 |
| 2003/0071043 | A1 | 4/2003 | Davis | | |
| 2004/0011790 | A1 * | 1/2004 | Woinarski | B65D 43/0256 | 220/276 |
| 2004/0112906 | A1 | 6/2004 | Von Holdt, Jr. | | |
| 2009/0314780 | A1 * | 12/2009 | Selina | B65D 43/0256 | 220/276 |

* cited by examiner

LID-CONTAINER ASSEMBLY MADE OF PLASTIC MATERIAL

CROSS REFERENCE TO EARLIER APPLICATION

This application is a § 371 National Stage Entry of PCT/EP2015/063881 filed Jun. 19, 2015. PCT/EP2015/063881 claims priority to Italian Patent Application No. MI2014A001140 filed Jun. 23, 2014. The entire content of these applications are incorporated herein by reference.

BACKGROUND OF THE INVENTION

The present invention relates to a lid-container assembly made of plastic material suitable for the transportation and storage of hazardous materials and in accordance with the restrictions of the corresponding UN specifications, especially in terms of resistance to shocks and internal pressure variations.

BRIEF DESCRIPTION OF THE PRIOR ART

The UN specifications governing the transportation and storage of hazardous materials require the containers used to have features that are such as to be able to overcome various constraints without difficulty.

The UN specifications (United Nations Specifications for the Transportation of Hazardous Materials) emphasise the effects of variation in the pressure inside a container on a volatile material subject to long term temperature and/or pressure variations. Equal emphasis is given to drop tests: such events could cause sudden increases in pressure inside a container full of material and accidental disengagement of the lid with consequent leakage of the product and pollution of the external environment. Accidental blows and vapours that are released inside the container generally lead to distortion, to exiting from the seat and also the breakage of the seals that normally ensure the seal between the lid and container.

Container-lid assemblies are known that form a seal with the containers by means of a gasket: these lids provide a good seal until the gasket gets worn, comes out of its seat, or even breaks. These assemblies are disclosed in patents like U.S. Pat. No. 5,163,576 and WO 01/12519.

Also container-lid assemblies are known in which the lid is provided with a system for tear opening, which is simpler to use, as in patent EP 1 923 321. Nevertheless, once the lid is closed, the seal that is obtained is not the desired one, in line with the UN specifications, and is not comparable with what would be obtained using a gasket.

Other container-lid assemblies of various design, which are provided with tear openings and are devoid of gaskets, represent the prior art. Nevertheless, as for example in U.S. Pat. No. 4,735,337, the need to ensure a good seal even after opening of the tear strip leads to systems of use-reuse being conceived that are unsuitable for seals conforming to UN specifications.

SUMMARY OF THE INVENTION

The main objective of the present invention is to provide a lid-container assembly that enables the drawbacks disclosed above to be overcome, in particular:

a substantial reduction in moulding time and assembly costs of the assembly, by eliminating the gasket but ensuring compliance with the UN specifications, owing to a multiple seal system through interference and contact;

a lid-container assembly in which the container is configured in a manner that is suitable for facilitating the removal thereof from the mould, at the same time permitting automatic assembly of the handle, according to the method that is the object of a previous patent, EP 1960177, of the same applicant;

a lid-container assembly that ensures great mechanical retention and a high degree of seal of the lid to the container, both before and after tear opening of the lid.

BRIEF DESCRIPTION OF THE DRAWINGS

In order to understand the invention better, an example is disclosed below by way of non-limiting example, illustrated in the attached drawings, in which.

DETAILED DESCRIPTION OF THE INVENTION

The invention relates to a lid-container assembly 1, 2 made of plastic material suitable for the transportation and storage of hazardous materials and in accordance with the restrictions of the corresponding UN specifications.

Figure 1:
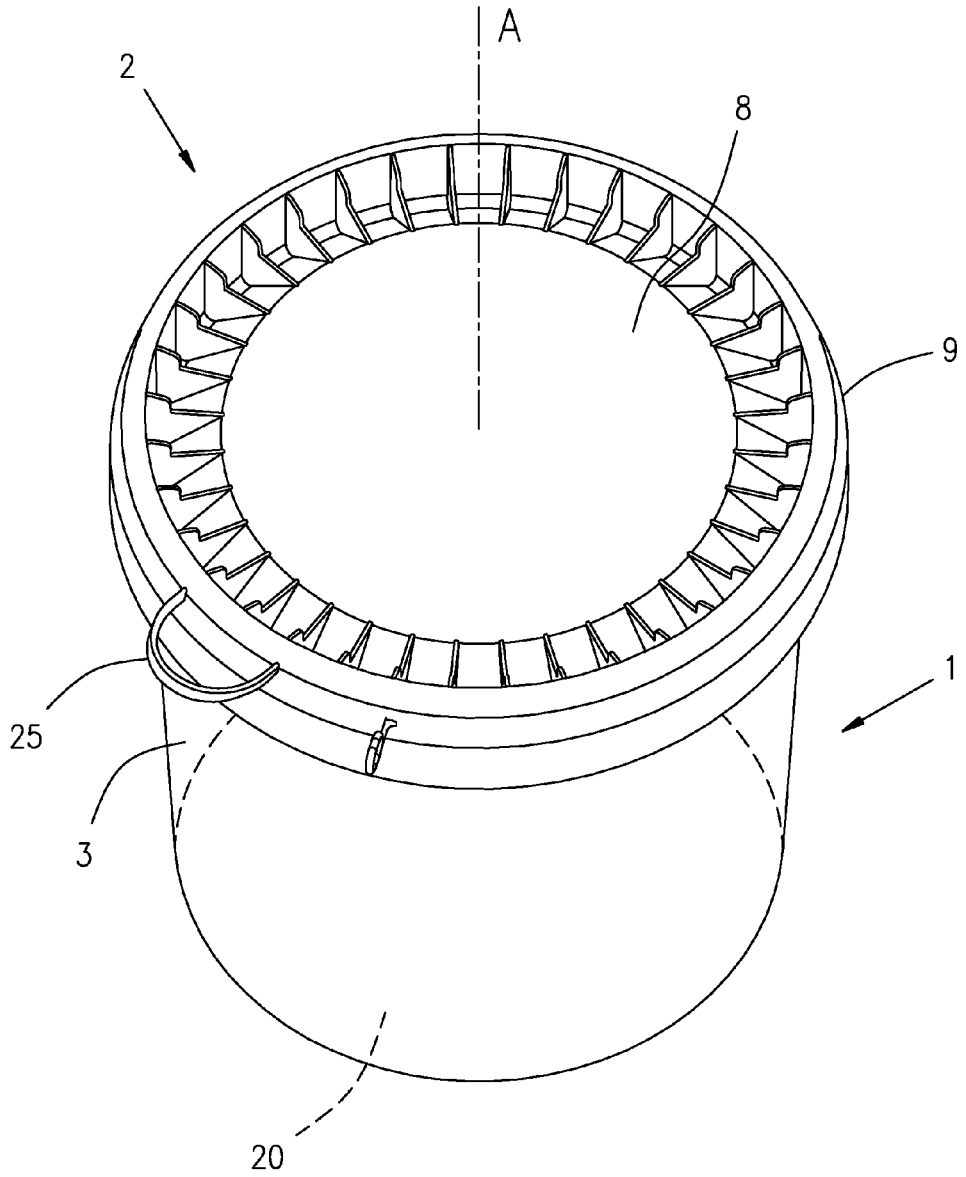
FIG. 1 shows a perspective view of the lid-container assembly.
Figure 2:
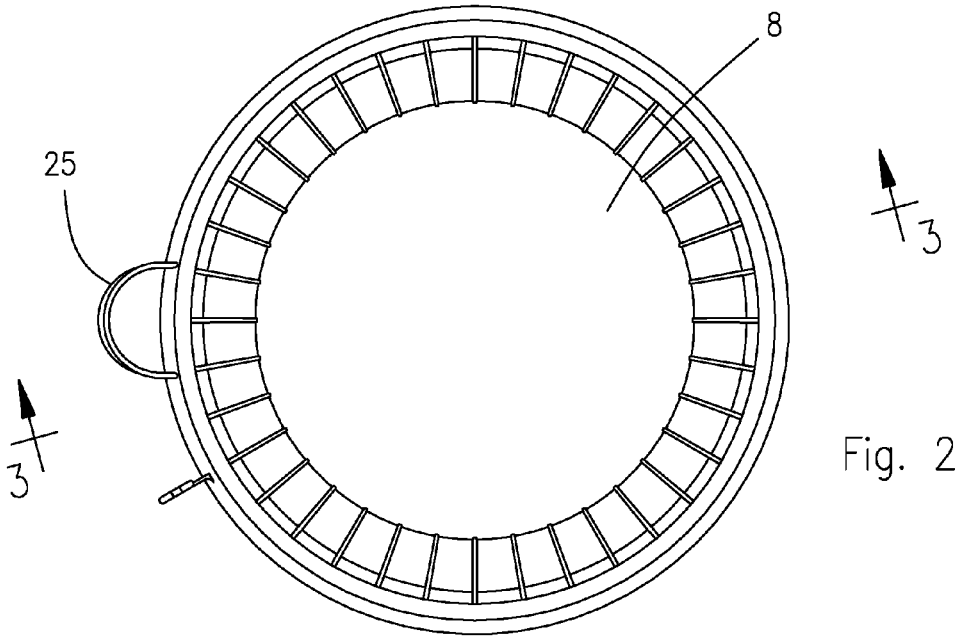
FIG. 2 shows a top view of the lid-container assembly of FIG. 1.
Figure 3:
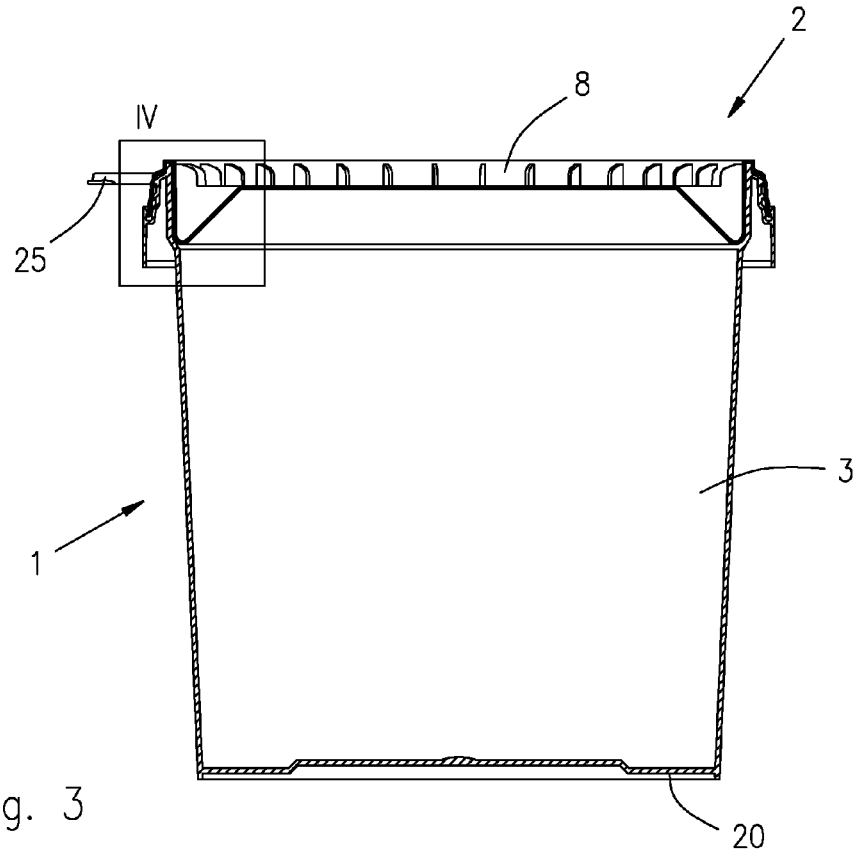
FIG. 3 shows a section of the lid-container assembly according to line 3-3 of FIG. 2.
Figure 4:
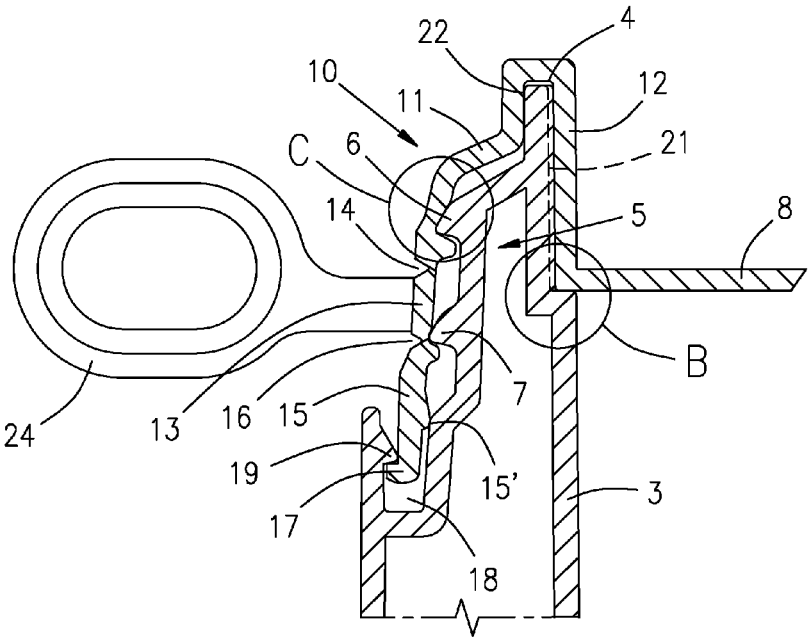
FIG. 4 shows an enlarged detail of FIG. 3 relating to the zone sealing and engaging the lid to the container.

With reference to FIG. 1, the container 1 comprises a bottom 20 of typically circular shape, connected to a substantially cylindrical or cone trunk side wall 3 around a longitudinal axis (A); the side wall 3 has an upper edge 4 that delimits and defines an access opening to the container 1 that will be closed by the lid 2 (ref FIG. 4).

As shown in the detail of FIG. 4, the container 1 is provided with a first external annular strip 5 with respect to the side wall 3: this strip 5 is provided with a first circular rib 6 and at least one second circular rib 7 that permit snap fitting of the lid 2 to the container 1; the annular strip 5 extends downwards, in a position spaced away from the upper edge 4 of the container 1. The circular ribs 6, 7 are bounded by conical contact surfaces.

The lid 2 comprises a central part 8 and a peripheral wall 9 that conforms to the side wall 3 of the container 1 (ref FIG. 4).

As shown in FIG. 4, the lid 2 further comprises a second external annular strip 10 that releasably engages the corresponding first external annular strip 5 of the container 1.

The second external annular strip 10 of the lid 2 comprises at least two annular elements 11, 13 (ref. FIG. 4), wherein the upper annular element 11 connects to the peripheral wall 9 by means of an upper annular channel 12 in the form of an upturned U (ref FIG. 4), and comprises in the example shown a lower annular element 15; further, the annular strip 10 of the lid 2 comprises an intermediate annular element 13 immediately below the upper annular element 11 connected to the latter by means of a first circular tear line 14 (ref FIG. 4), and to the lower annular element 15 by means of a second tear line 16.

Still with reference to FIG. 4, the external annular strip 5 of the container 1 and the external annular strip 10 of the lid 2 have facing surfaces that comprise different opposite ribs such as to enable the lid 2 to be engaged to the container 1.

Further, the intermediate annular element 13 of the lid 2 is provided with a tab 24 to enable the removal thereof and thus facilitate the first tear opening of the lid 2, which can be subsequently reclosed (ref FIG. 4).

FIG. 4 shows the end part of the lower annular element 15 formed by an edge provided with a rib 17 that extends inside an upwardly open U-shaped lower annular channel 18, being part of the external annular strip 5 of the container 1.

This edge is engaged to a corresponding inner rib 19 of the lower annular channel 18 of the external annular strip 5 of the container 1 (ref FIG. 4).

FIG. 1 further shows a handle 25 that is useful for facilitating the opening/closing actions of the lid 2 at the upper annular element 11 of the annular strip 10 of the lid 2.

Henceforth, reference will again be made to FIG. 4, unless indicated otherwise.

The lid-container assembly 1, 2 further comprises a first 21 interference sealing zone between opposing surfaces of the side wall 3 of the container 1 and of the peripheral wall 9 of the lid 2.

The lid-container assembly 1, 2 further comprises a second 22 contact sealing zone in the zone in which the upper edge 4 of the side wall 3 of the container 1 extends inside the upper annular channel 12.

Figure 6:
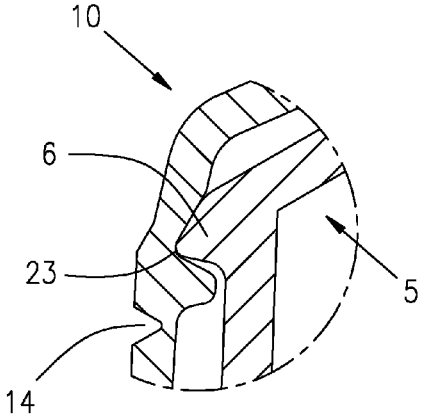
FIG. 6 shows a detail C of FIG. 4.

The assembly also comprises a third 23 contact sealing zone between opposite ribs of the external annular strips 10, 5 of the lid 2 and of the container 1 (ref FIG. 6), at the upper annular element 11.

In the condition in which the intermediate annular element 13 has not yet been removed from the lid 2, the seal capacities of the lower annular element 15 are maintained intact; there are three relevant points for this purpose: the upper edge at the second circular rib 7 of the first external annular strip 5, the lower edge at the internal rib 19 at the lower annular channel 18 and a rib 15' placed about halfway up the lower annular element 15 in contact with the first external annular strip 5.

The lower edge of the annular element 15 is formed by a rib 17 that extends inside an upwardly open U-shaped lower annular channel 18, forming part of the external annular strip 5 of the container 1; this rib 17 engages a corresponding internal rib 19 of the lower annular channel 18 of the external annular strip 5 of the container 1, ensuring strong mechanical engagement.

The rib 15' located about halfway up the lower annular element 15 comes into contact with the external annular strip 5 of the container 1 and enables the free buckling length to be halved and the accidental disengagement of the lid 2 to be prevented in the event of a fall or strong internal pressure.

The assembly that is thus disclosed is characterised by the absence of a gasket that enables problems to be avoided relating to wear, to the gasket exiting from its seat or even to the breakage of the gasket.

The lid 2 can be provided with different types of tear tab 24.

Figure 5:
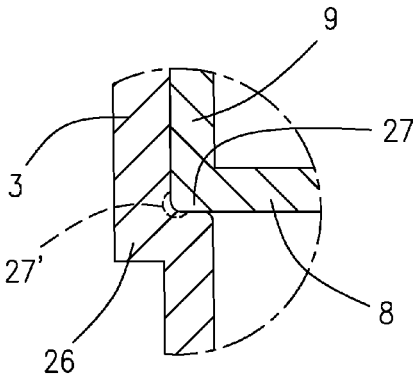
FIG. 5 shows a detail B of FIG. 4.

One possible configuration of the invention, shown in detail in FIG. 5, provides the possibility furnishing a further interference seal 27' between the step 26 and corresponding edge 27 of the side wall 3 of the container 1 so as to implement the degree of seal. This solution also enables numerous containers to be stocked stacked on top of one another, being able to ensure greater resistance to the loads transmitted by the upper containers to the lower containers.

The present invention thus relates to a lid-container assembly 1, 2 provided with an intermediate tear annular element 13 for opening the lid 2, which is devoid of a gasket but which ensures a good hermetic seal of the lid 2 and firm engagement with the container 1 once the intermediate tear annular element 13 is removed.

In the example in FIG. 4 the annular strip 10 of the lid 2 has an upper engaging and sealing annular element 11, a lower engaging annular element 15 and an intermediate tear annular element 13; nevertheless, in one possible version, the lower engaging annular element 15 could also be missing, without prejudice to sealing features according to UN specifications between the annular strips 5, 10 of the container 1 and of the lid 2, to prevent an accidental leak of the material from the container 2.

The invention claimed is:

1. An assembly made of synthetic plastic material comprising a lid and a container, wherein the container comprises:

a bottom connected with one of a substantially cylindrical side wall and a cone trunk around a longitudinal axis;

the side wall having an upper edge defining an access opening to the container, a first external annular strip outside the side wall provided with a first circular rib and at least one second circular rib engaging the lid of the container;

wherein the lid comprises:

a central part and a peripheral wall that conforms with the side wall of the container and comprises a second external annular strip that releasably engages the first external annular strip of the container;

the second external annular strip comprising an upper annular element that connects to the peripheral wall by an upper, upturned U-shaped annular channel and at least one intermediate annular element below and connected with the upper annular element by a first circular tear line; and wherein facing surfaces of the first external annular strip of the container and the second external annular strip of the lid comprise further opposite engaging ribs;

wherein the assembly further comprises:

a first interference sealing zone between opposite surfaces of the side wall of the container and of the peripheral wall of the lid;

a second contact sealing zone between an upper edge of the container and the upper annular channel of the lid; and a third contact sealing zone between opposite ribs of the first and second external annular strips;

and wherein the second external annular strip of the lid comprises a lower annular element that extends downwards and is connected by a second tear line to the intermediate annular element, said lower annular element of the second external annular strip of the lid, terminating with a peripheral edge configured with a rib that extends into a lower upturned U-shaped annular channel that engages a corresponding rib inside the aforesaid lower upturned U-shaped annular channel of the first external annular strip of the container.

2. An assembly made of synthetic plastic material comprising a lid and container according to claim 1, wherein the circular ribs are bounded by conical contact surfaces.

3. An assembly made of synthetic plastic material comprising a lid and container according to claim 1, and further comprising a step on an inner part of the side wall of the container to define a further interference seal.

4. An assembly made of synthetic plastic material comprising a lid and container according to claim 1, further comprising a lid handle integral with the upper annular element of the second external annular strip.

* * * * *